United States Patent [19]

Harburn et al.

[11] 4,329,862

[45] May 18, 1982

[54] SHOT PEEN FORMING OF COMPOUND CONTOURS

[75] Inventors: Brian Harburn, Seattle; John C. Miller, Des Moines, both of Wash.

[73] Assignee: The Boeing Company, Seattle, Wash.

[21] Appl. No.: 114,017

[22] Filed: Jan. 21, 1980

[51] Int. Cl.[3] ..... B21J 5/00; C21D 7/06

[52] U.S. Cl. ..... 72/53

[58] Field of Search ..... 72/53, 40; 51/319

[56] References Cited

U.S. PATENT DOCUMENTS 2,701,408 2/1955 Borger ..... 72/53

3,000,425 9/1961 Hodges ..... 72/53

3,004,584 10/1961 Fuchs ..... 72/53

3,668,912 6/1972 Baughman ..... 72/53

*Primary Examiner*—Gene P. Crosby

*Attorney, Agent, or Firm*—Morris A. Case; Bernard A. Donahue

[57] ABSTRACT

A flat sheet metal part is shot peened on both sides with an intensity programmed to vary in a pattern for imparting localized growth matching the part to a spanwise curvature of a contoured aircraft wing. The part is shot peened on one side with an intensity programmed to vary in a pattern for matching the part to a chordwise curvature, and the part takes on the compound curvature of an aircraft wing surface.

8 Claims, 7 Drawing Figures

SHOT PEEN FORMING OF COMPOUND CONTOURS

BACKGROUND OF THE INVENTION

A flat sheet can be formed to a single element curvature in either direction by simple bending. Adding a second direction of curvature requires stretching of the sheet. The contours of most wing skins on current model airplanes are a composite of chordwise and spanwise curvatures. These compound curvatures, called saddlebacks, are generally produced by shot peen forming the chordwise curvature and draping the spanwise curvature during the wing assembly operations. Only very large spanwise curves can be draped on assembly. Skins having severe spanwise curves require forming of both chordwise and spanwise curvature prior to assembly. Elevated temperature creep forming in large fixtures, pre-stress fixturing during shot peening, and press brake chip forming prior to shot peening are some of the methods used to form severe saddlebacks prior to assembly.

U.S. Pat. No. 3,668,912 teaches a centrifugal shot throwing wheel that may be used to obtain limited saddleback formation by shot peening on one side of a wing surface to obtain a curvature, placing shielding material adjacent a streamwise line, and shot peening one surface of the wing along the streamwise line.

U.S. Pat. No. 2,701,408 teaches a method of providing a curved surface by shot peening one side of a part as it passes through shot peening equipment. Should too great a curvature be obtained the part is turned over and passed through shot peening equipment using shot at a lower intensity.

It was found that a wing skin can be formed to a varying compound contour by selective shot peening.

SUMMARY OF THE INVENTION

Segments of a flat sheet metal part are compared with a compound contoured wing surface, the amount of growth within the segments is determined to match spanwise contour to the contoured wing surface, and the amount of chordwise curvature within segments is determined to match the contoured surface. Shot peening the part on both sides with Almen intensity varying from segment to segment imparts controlled growth to the part, and shot peening on one side with Almen intensity varying from segment to segment imparts chordwise curvature to the part.

DETAILED DESCRIPTION

Figure 1:
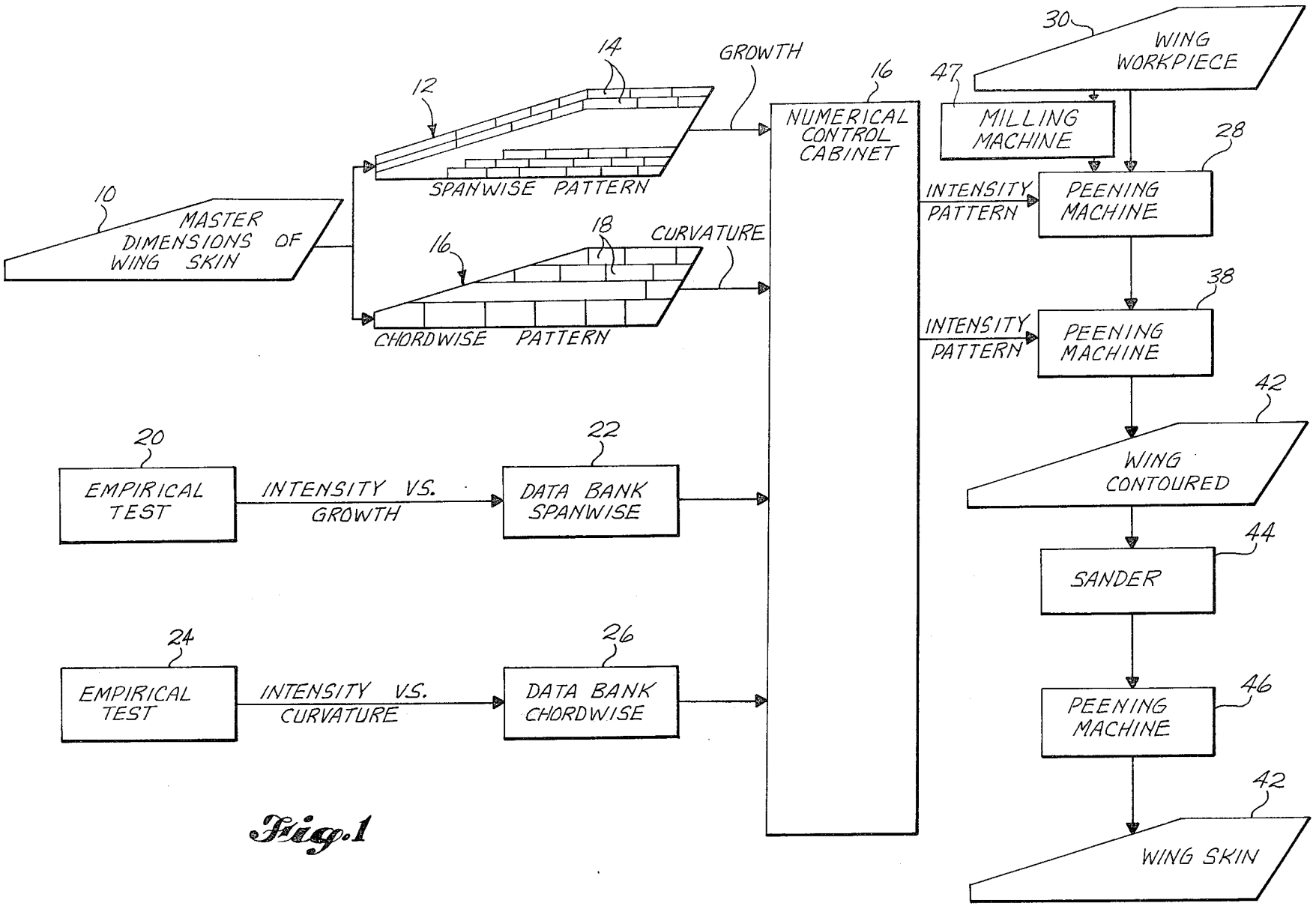
FIG. 1 shows a schematic of the process of this patent.
Figure 2:
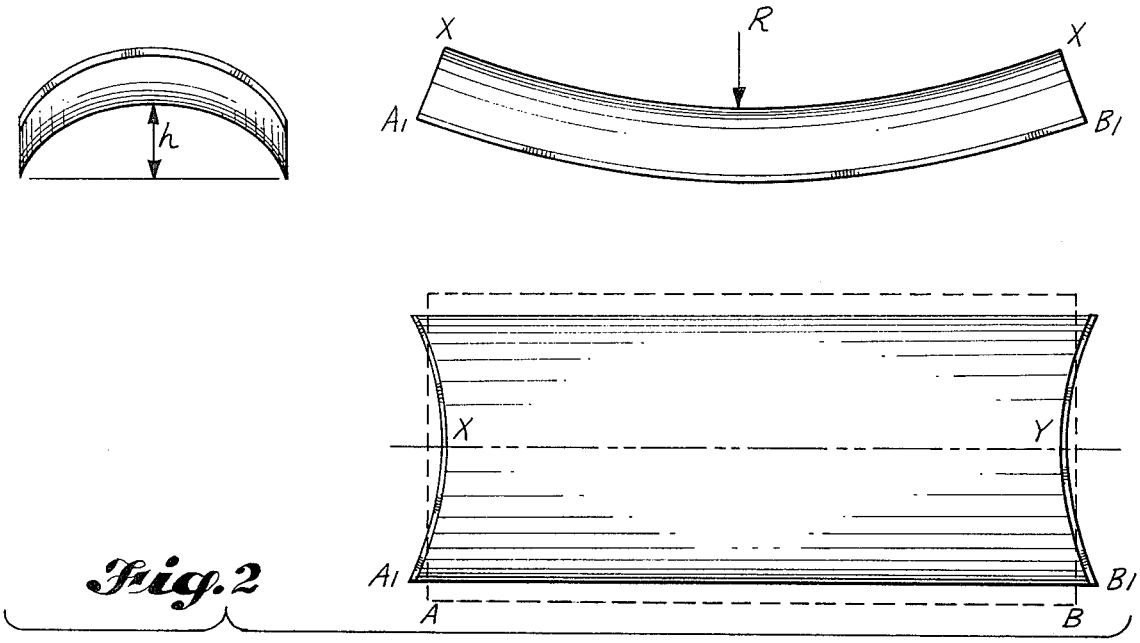
FIG. 2 shows a plan, side, and end view of a compound contoured part.

FIG. 2 shows three views of a thin metal part of saddleback or compound contour having constant lengthwise and widthwise radius of curvatures. To obtain the contour from a flat sheet, shown by the dotted lines, length AB must be elongated to $A_1$ $B_1$, and length XY will remain unchanged. Elements of lengths between XY and AB will require an increasing elongation from zero at XY to a maximum at $A_1$ $B_1$, according to the formula:

$$\text{Growth} = \frac{h}{R - h} = \text{inches/inch}$$

Where h=arc or chordwise height (inches)

R=lengthwise or spanwise radius (inches).

A given compound contour can therefore be defined mathematically in terms of growth required at any number of locations across the part width to obtain that shape from the flat sheet.

The contour of an aircraft wing is defined by master dimensions and a mold 10 prepared to simulate that surface. A flat sheet 12 is compared to the desired compound contoured mold surface by laying out a spanwise pattern 14 of essentially rectangular segments located near the leading and trailing edges of the sheet; which are the areas where growth is required to match the flat sheet to the spanwise curvature of the mold surface. The growth within each segment is determined, and that information is fed into numerical control cabinet 16.

A flat sheet 16 is compared to the desired compound contoured mold surface by laying out a chordwise pattern 18 of essentially rectangular segments. The amount of chordwise curvature, to match the flat sheet to the chordwise curvature of the mold surface, is determined for each segment, and that information is fed into the cabinet.

A series of tests 20, were performed on test specimens of various alloys and various thicknesses of metals, used for wing skins, by shot peening both sides of the specimens at varying Almen intensities for empirical determination of the amount of growth versus Almen intensity. This information was fed into a data bank 22, and thence into the numerical control cabinet.

A series of tests 24 were performed on test specimens of various alloys and various thicknesses of metals used for wing skins by shot peening on one side only of test specimens at varying Almen intensities, and determining the amount of chordwise curvature versus Almen intensity. The information was fed into a data bank 26, and thence into the numerical control cabinet.

Tests were conducted on aluminum alloys of 2024, 2324, 7050, 7075 and 7150, and the thicknesses were varied through 0.18, 0.25, and 0.31 inches. Steel shot was used that ranged through 0.046, 0.125, 0.156, and 0.187 inches in diameter. These conditions are shown for example only as it is not desired to be limited to these conditions.

Shot peening may be accomplished in a single machine, however, it is preferred to use two different machines. Spot peen machine 28 is used to impart growth by peening both sides of wing workpiece 30. The workpiece is suspended from a pair of fixtures 32; which are mounted to roll on an overhead rail 34. The shot peen machine 28 uses a series of centrifugal, wheel type shot throwers 36, that are mounted on both sides to throw the shot horizontally to accomplish the peening in narrow band widths on both sides of the skin. These wheels are also mounted to be tilted to provide a shot pattern at an angle away from horizontal. A sufficient number of wheels may be used to accomplish the growth patterns on one pass through; or the workpiece may make multiple passes to accomplish the peening, as the wheels are mounted to be raised, lowered and tilted to cover different areas. It is preferred to align the workpiece with one edge of the workpiece horizontal. The wheels covering or adjacent to that edge are kept horizontal, and the wheels covering or adjacent to the opposite edge of the workpiece are tilted to match that edge. The wheels are raised or lowered as required to remain parallel to the second edge as the workpiece progresses through the peen machine. The positioning of the wheels and the shot intensity coming from the wheels is controlled by the numerical control cabinet 16 to mesh with the speed of the workpiece as it goes through the peen machine to provide the patterned growth to match the workpiece to the spanwise curvature of the surface wing mold 10.

Shot peen machine 38 is used to impart chordwise curvatures by shot peening one side only of the workpiece. This machine uses a series of shot throwing wheels 40 that are mounted to throw the shot in a vertical pattern, and uses a sufficient number of wheels to cover the workpiece in a single pass through. The shot intensity is varied to impart a patterned curvature and this intensity is controlled by numerical control cabinet 16.

Once the peening in the two peen machines is accomplished the workpiece is completely formed as at 42 to match the contour of the compound contoured wing mold. In those situations where the workpiece is thick; so that large size shot is required to effect the necessary growth it is required to use the post peening operation of sanding, as at 44, to improve the surface finish to an acceptable aerodynamic smoothness and aesthetic appearance. In this situation, and also where fatigue improvement compression peening as at 46 is required, as a post peen forming operation, data banks 22 and 26 are supplemented with data to compensate for the contour modifying effects of the post peen forming operations.

Figure 3:
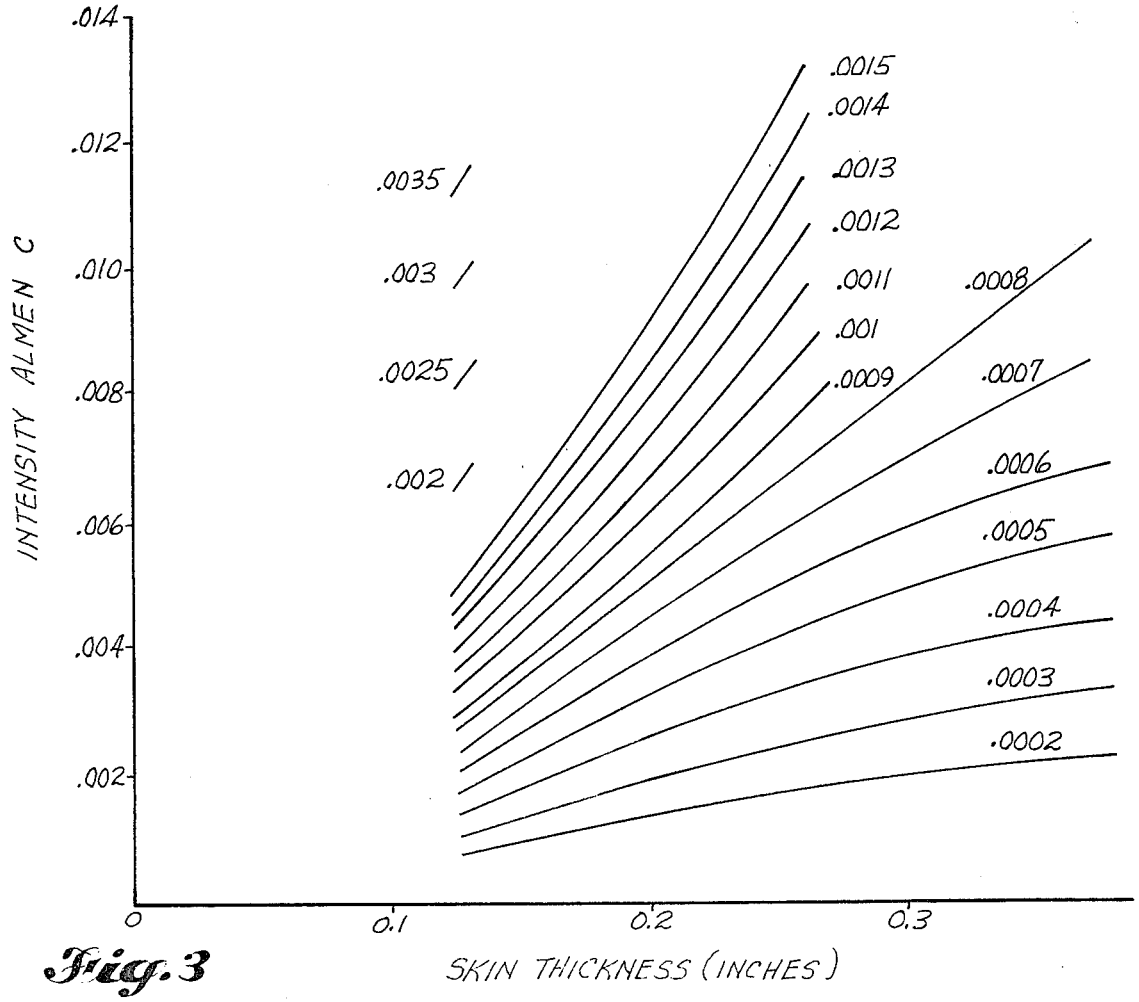
FIG. 3 shows growth lines in an aluminum alloy as a function of the Almen intensity and skin thickness of the alloy when shot peened on both sides.

FIG. 3 shows a graph obtained by using a 0.156 inch diameter shot to shot peen both sides of test specimens of an aluminum 7050 alloy at various thicknesses. The graph shows an ordinate of Almen intensity, and the abscissa of skin thickness, while the lines reflect growth. This graph is typical and illustrates the information used to prepare data bank 22. This Almen intensity versus growth for a specific alloy and of a certain thickness is compared with the growth required in spanwise pattern segments 14 to generate an Almen intensity pattern as the signals to control peening machine 28.

In the process of forming a compound contoured wing skin 42, a flat workpiece 30, has been milled in a milling machine 47 on one side by tapering the workpiece to be thinner near the end to effect a weight savings. Areas of the workpiece are divided into segments 14, and the amount of growth within each segment is determined by comparing those segments with the mold 10, which reflects the master dimensions for the wing skin. This growth is compared with information, based on the same alloy and same thickness as the workpiece, from the spanwise data bank 22, to determine the Almen intensity pattern required to form the spanwise curvature by shot peening both sides of the workpiece. The numerical control cabinet programs this signal to the shot peen machine 28, and the workpiece is shaped in the spanwise direction.

Areas of the workpiece are also divided into segments 18 of the chordwise pattern and the amount of curvature within each segment is determined by comparing those segments with the mold 10. This chordwise curvature is compared with information, based on the same alloy and the same thickness as the workpiece, from the chordwise data bank 26, to determine the Almen intensity pattern required to form the chordwise curvature by shot peening on one side of the workpiece. The numerical control cabinet programs that signal to the shot peen machine 38, and the workpiece is shaped in the chordwise direction.

Figure 4:
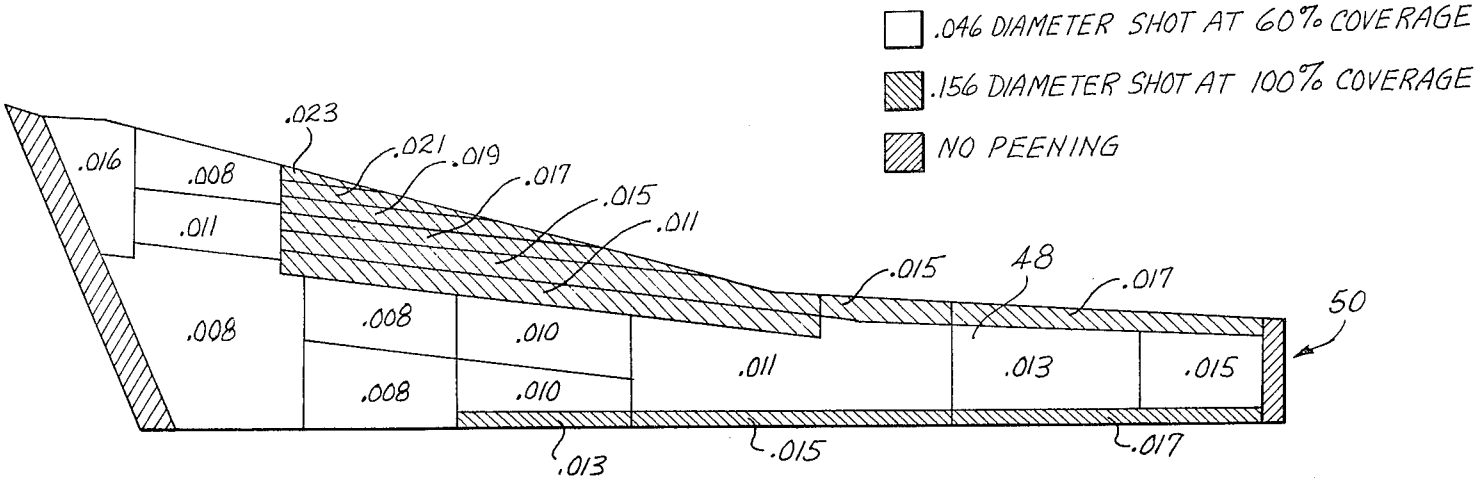
FIG. 4 shows a peening pattern for an upper forward wing skin outer surface.
Figure 5:
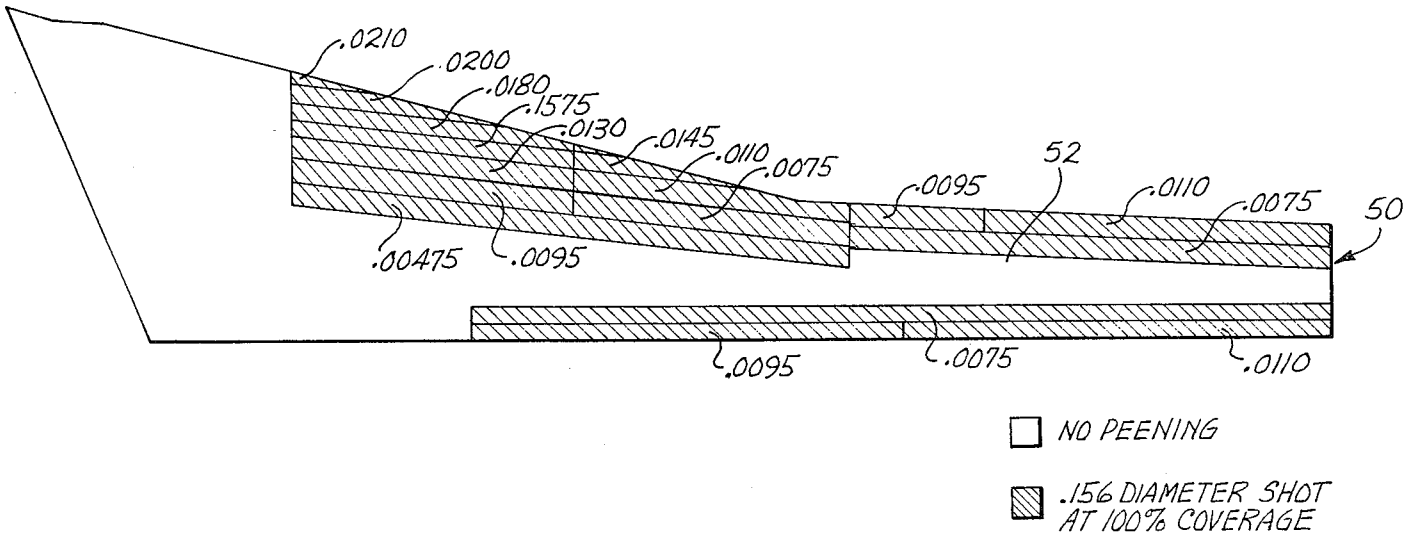
FIG. 5 shows a peening pattern for the inner surface of the wing skin of FIG. 4.
Figure 6:
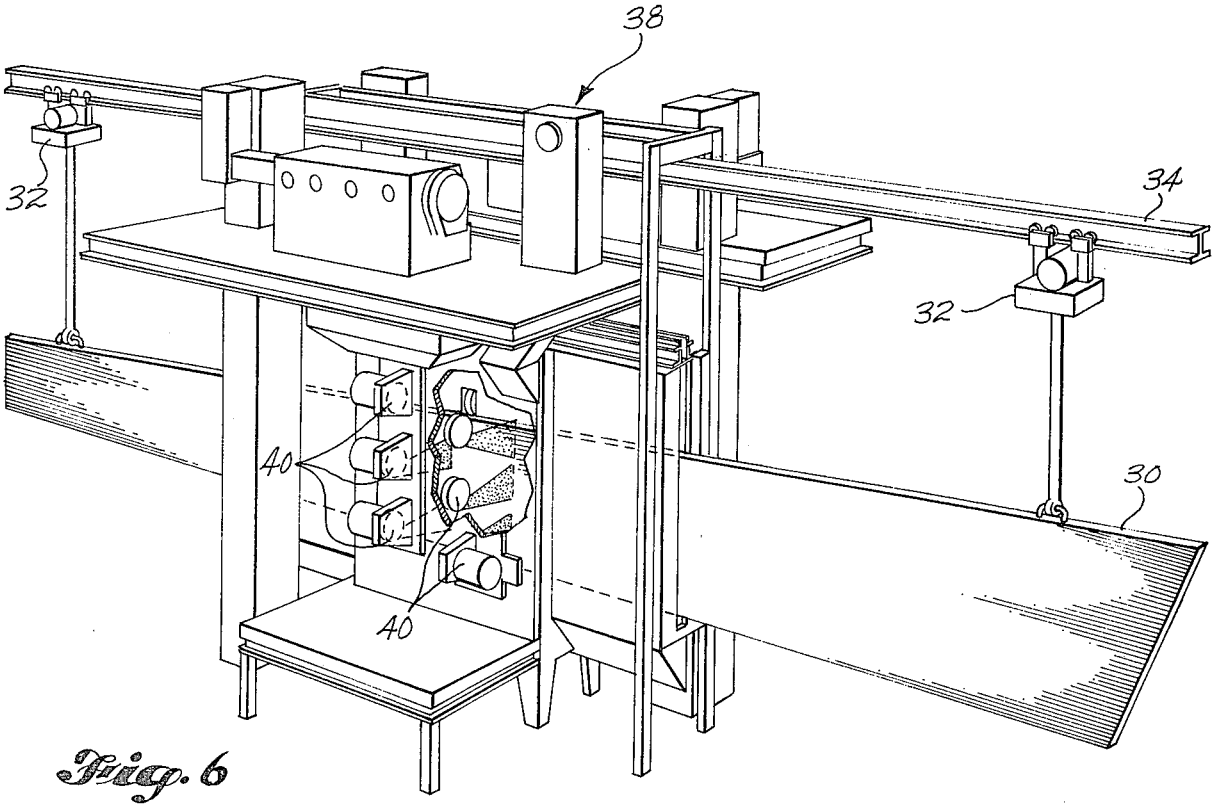
FIG. 6 shows a perspective view of a wing skin passing through peening equipment for imparting chordwise curvature.
Figure 7:
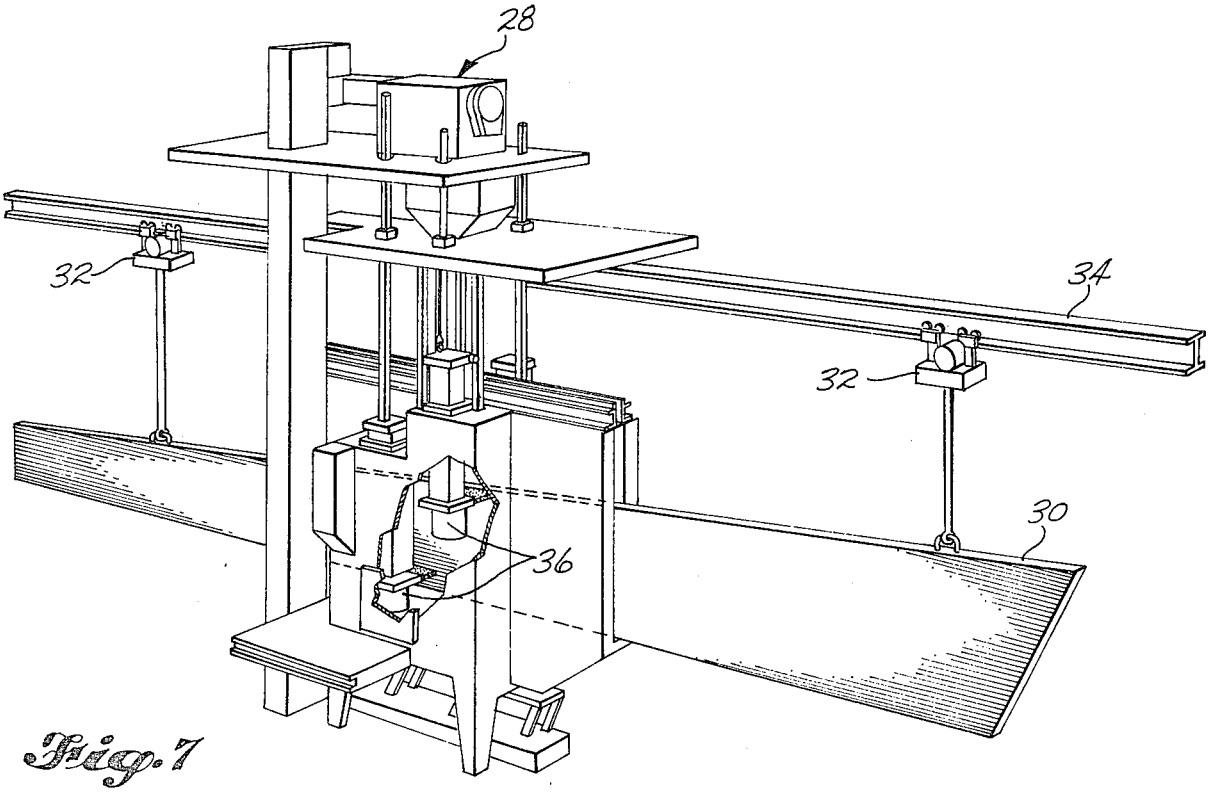
FIG. 7 shows a perspective view of a wing skin passing through peening equipment for imparting growth.

FIG. 4 shows an outer surface 48 of a wing skin 50, and FIG. 5 shows the inner surface 52 of the wing skin. These surfaces are divided into narrow segments on each side with each segment showing the Almen intensity within that segment to obtain growth for spanwise curvature. The varying intensity being almost identical on each side selectively stretches the skin, as is illustrated in FIG. 2. The intensity is slightly greater on the outer surface to impart curvature in the chordwise direction. The outer surface 48 is also divided into additional segments and each of those segments show the Almen intensity within the segment for imparting chordwise growth to the wing surface.

We claim:

1. A method of imparting a compound contour to a sheet metal part, with the steps comprising: passing a sheet metal part through shot peening equipment, shot peening the part on both sides while varying the shot intensity in a pattern for localized growing imparting varying curvature, and shot peening the part on one side while varying the shot intensity in a pattern for imparting varying curvature in a second direction with the combination of shot peening permitting the part to conform to a compound contour.

2. A method of forming a wing skin having a compound contour from a flat sheet of metal, with the steps comprising: comparing segments of a flat sheet metal part with a compound contoured wing surface for an aircraft, determining the amount of growth required in each segment of the part to match the spanwise curvature of the contoured wing surface, shot peening the part on both sides while varying the intensity from segment to segment for localized growing of the segments forming the part to match the spanwise curvature of the wing, shot peening the part on one side only while varying the intensity for forming the part to the chordwise curvature, and matching the formed part to the compound contour of the wing.

3. A method of forming a wing skin having a compound contour as in claim 2, with the further step of milling the part on one side prior to the shot peening.

4. A method of forming a wing skin having a compound contour as in claim 2 with further steps comprising: preparing a data bank of Almen intensity versus growth by shot peening both sides of specimens of an alloy and of a thickness the same as the sheet metal part, utilizing the data bank for programming the shot peening equipment, preparing a data bank of Almen intensity versus imparted curvature by shot peening one side of specimens of an alloy and of a thickness the same as the sheet metal part, and utilizing the second data bank for programming the shot peening equipment.

5. A method of forming a wing skin having a compound contour as in claim 3 with further steps comprising: preparing a data bank of Almen intensity versus growth by shot peening both sides of specimens of an alloy and of a thickness the same as the sheet metal part, utilizing the data bank for programming the shot peening equipment, preparing a data bank of Almen intensity versus imparted curvature by shot peening one side of specimens of an alloy and of a thickness the same as the sheet metal part, and utilizing the second data bank for programming the shot peening equipment.

6. A method of forming an aircraft wing skin, having a compound contour, from sheet metal, with the steps comprising: dividing the surface of sheet metal into segments, determining the amount of growth required within each individual segment for permitting the sheet to match spanwise curvature of a wing skin to be formed, preparing a data bank of Almen intensity required to obtain growth in segments of metal specimens of an alloy and thickness the same as the sheet metal used for forming the wing skin with the data determined by shot peening both sides of the specimens, matching the Almen intensity from the data bank to the growth requirements of various segments of the sheet metal, shot peening the sheet metal on both sides at the matching Almen intensity forming the sheet metal to the spanwise curvature required in the wing skin, determining the Almen intensities required by shot peening the side of specimens having the same alloy and thickness as the sheet metal to effect a chordwise curvature required in the wing skin, and shot peening the sheet metal on one side with the determined Almen intensities to shape the sheet metal to the compound contoured wing skin.

7. A method of forming an aircraft wing skin from sheet metal as in claim 6, with steps further comprising: sanding the formed wing skin, and then compression peening.

8. A method of forming a compound contoured wing skin from sheet metal, with steps comprising: determining the amount of growth in patterned segments of a sheet metal part for growing the part to match spanwise curvature of a compound contoured wing, utilizing that growth in patterned segments for programming Almen intensity into a machine that shot peens both sides of a part using information from a data bank of Almen intensity versus growth derived from shot peening both sides of specimens of an alloy and thickness the same as the sheet metal part, determining the amount of growth in patterned segments of the sheet metal part for growing the part to match chordwise curvature of a compound contoured wing, utilizing that growth in patterned segments for programming patterned Almen intensity into a one side only shot peen machine using information from a data bank of Almen intensity versus imparted curvature derived from shot peening one side of specimens of an alloy and thickness the same as the sheet metal part, suspending the sheet metal part from a conveyor, and growing the part into a compound contoured wing skin by passing the part through the programmed shot peening machines.

* * * * *